US012453386B2

(12) United States Patent
O'Leary

(10) Patent No.: US 12,453,386 B2
(45) Date of Patent: Oct. 28, 2025

(54) WEARABLE LEG WARMER

(71) Applicant: Corinne O'Leary, Rockville, MD (US)

(72) Inventor: Corinne O'Leary, Rockville, MD (US)

(73) Assignee: Corinne Emily O'Leary, Rockville, MD (US)

( * ) Notice: Subject to any disclaimer, the term of this patent is extended or adjusted under 35 U.S.C. 154(b) by 537 days.

(21) Appl. No.: 17/715,826

(22) Filed: Apr. 7, 2022

(65) Prior Publication Data

US 2022/0322763 A1 Oct. 13, 2022

Related U.S. Application Data

(60) Provisional application No. 63/174,245, filed on Apr. 13, 2021.

(51) Int. Cl.

| | |
|---|---|
| ***A41D 13/05*** | (2006.01) |
| *A47G 9/02* | (2006.01) |
| *A47G 9/08* | (2006.01) |

(52) U.S. Cl.

CPC ..... *A41D 13/0543* (2013.01); *A41D 2400/10* (2013.01); *A47G 9/0207* (2013.01); *A47G 9/0223* (2013.01); *A47G 9/08* (2013.01)

(58) Field of Classification Search

CPC . A41D 13/0543; A41D 2400/10; A41D 13/06
See application file for complete search history.

(56) References Cited

U.S. PATENT DOCUMENTS

| | | | | | |
|---|---|---|---|---|---|
| 1,767,842 | A * | 6/1930 | Gehrke | A47G 9/04 | 2/69.5 |
| 1,808,233 | A * | 6/1931 | Kamrath | A61F 7/0085 | 2/69 |
| 2,146,400 | A * | 2/1939 | Maker | A47G 9/066 | 2/69 |
| 2,530,606 | A * | 11/1950 | Farrington | A41B 13/06 | 2/69.5 |
| 5,956,768 | A * | 9/1999 | Pearson | A47G 9/0207 | 2/22 |
| 7,043,782 | B2 * | 5/2006 | Batchler | A47G 9/066 | 2/69.5 |
| D970,162 | S * | 11/2022 | Xu | A47G 9/066 | D2/919 |
| D971,565 | S * | 12/2022 | Zhao | D2/919 | |
| 2006/0117598 | A1 * | 6/2006 | Czaplewski | A43B 3/242 | 36/7.1 R |
| 2022/0322763 | A1 * | 10/2022 | O'Leary | A41D 13/0543 | |

* cited by examiner

*Primary Examiner* — Gloria M Hale

(57) ABSTRACT

A wearable leg warmer that includes a soft clothing fabric, a sewing thread, and a stretchable binder is disclosed. Longitudinal edges of the soft clothing fabric are folded laterally and stitched utilizing the sewing thread to form a pouch with a lateral opening. The stretchable binder is enclosed at the vicinity of the lateral opening to prevent slipping of the wearable leg warmer. The sewing thread is utilized to stitch in the middle of the pouch to enable division of the lateral opening into two lateral opening portions and enable insertion and withdrawal of legs of the user with minimal human effort, thus retaining body heat of the user and warming feet of the user. The wearable leg warmer provides maximum comfort level to a user during prolonged exposure to induce sleep naturally.

22 Claims, 5 Drawing Sheets

WEARABLE LEG WARMER

CROSS-REFERENCE TO RELATED APPLICATION

This application claims the benefit of U.S. Provisional Application No. 63/174,245 filed on Apr. 13, 2021. The above identified patent application is herein incorporated by reference in its entirety to provide continuity of disclosure.

TECHNICAL FIELD

The present disclosure relates generally to a wearable leg warmer and a method to form a wearable leg warmer, and more particularly, to a wearable leg warmer and a method to form a wearable leg warmer to retain body heat and induce sleep naturally.

BACKGROUND

The human body mandates maintenance of consistent body temperature to function smoothly including uninterrupted sleep. The legs including lower-legs and specifically feet display tendency of losing body heat through conduction, radiation, convection leading to lowering of the ideal body temperature and inability/difficulty in falling asleep. Blankets and Quilts provide means to retain body heat but not specifically to lower-legs and/or feet. Wearing socks while going to sleep has been an adopted habit of retaining body heat but overheating of the feet/lower-legs due to prolonged usage of socks disturbs sleep of the user and forces user to wake-up and take-off the socks leading to frequent ad-hoc sleep interruptions thus resulting in irregular sleep patterns.

The existing state-of-art provides diverse options to address warming of the lower-legs/feet in particular using either an external heating component either directly in physical contact with the lower-legs/feet or heating through cloth/enclosing jackets to compensate for the body heat lost through lower-legs/feet. Using electricity and associated heat regulation devices leads to high cost and required careful maintenance while still risky to operate and non-portable. Such devices are unsuitable for keeping unattended over night or for prolonged usage as it may result into overheating.

For the aforementioned reasons, there is a need for providing a wearable leg warmer and a method to form a wearable leg warmer for retaining body heat and warming legs of the user by overcoming the aforementioned problems of the conventional wearable leg warmers.

SUMMARY

In one embodiment, a wearable leg warmer is disclosed. The wearable leg warmer includes a soft clothing fabric, a sewing thread, and a stretchable binder. The soft clothing fabric is defined within multiple lateral edges and multiple longitudinal edges. The soft clothing fabric for the wearable leg warmer provides maximum comfort level to a user during prolonged exposure to the wearable leg warmer. Each longitudinal edge of the multiple longitudinal edges folded is laterally to overlap with respect to a lateral axis, thus forming multiple folded longitudinal edges. The sewing thread is utilized to stitch along each of the multiple longitudinal edges to form a pouch with a lateral opening. The stretchable binder is positioned and enclosed at the vicinity of the lateral opening of the pouch. The sewing thread is utilized to stitch along a longitudinal axis in the middle of the pouch to enable division of the lateral opening into multiple lateral opening portions and enable insertion and withdrawal of legs of the user, thus retaining body heat of the user and warming feet of the user.

In some examples, the stitch along the longitudinal axis in the middle of the pouch extends from the lateral opening till at least a predefined length, thus enabling foot of each leg of the user inserted in corresponding lateral opening portion of the multiple lateral opening portions to be in physical contact with each other.

In some examples, the stitch along the longitudinal axis in the middle of the pouch extends from the lateral opening to an entire length of the pouch, thus enabling foot of each leg of the user inserted in corresponding lateral opening portion of the multiple lateral opening portions to remain isolated from each other.

In some examples, the soft clothing fabric for the wearable leg warmer corresponds to a sherpa material.

In some examples, the multiple longitudinal edges include two longitudinal edges and the multiple lateral edges include two lateral edges.

In some examples, a separation between the lateral edges of the soft clothing fabric is greater than a separation between the longitudinal edges of the soft clothing fabric.

In some examples, each longitudinal edge of the multiple longitudinal edges is folded laterally to form the multiple folded longitudinal edges having a length based on a predefined size associated with the user.

In some examples, the sewing thread is utilized to stitch along each of the folded longitudinal edges and along the longitudinal axis in the middle of the pouch corresponds to at least one of: a natural thread and a synthetic thread to form a seam pattern.

In some examples, the lateral edges of the soft clothing fabric of the wearable leg warmer are rendered parallel to each other after folding the longitudinal edges.

In some examples, the pouch employs a casing at the vicinity of the lateral opening to enclose the stretchable binder.

In some examples, the stretchable binder positioned and enclosed at the vicinity of the lateral opening of the pouch prevents the wearable leg warmer from slipping off the legs of the user during prolonged usage of the wearable leg warmer.

In some examples, the stretchable binder positioned and enclosed at vicinity of the lateral opening of the wearable leg warmer enables the user to withdraw the legs from the wearable leg warmer with minimal human effort.

In some examples, the stretchable binder corresponds to an elastic material.

In another embodiment, a method for forming a wearable leg warmer to retain body heat is disclosed. The method includes selecting a soft clothing fabric defined within multiple lateral edges and multiple longitudinal edges. The soft clothing fabric for the wearable leg warmer provides maximum comfort level to a user during prolonged exposure to the wearable leg warmer. The method further includes folding each longitudinal edge of the multiple longitudinal edges laterally to overlap with respect to a lateral axis, thus forming multiple folded longitudinal edges, and stitching utilizing a sewing thread along each of the folded longitudinal edges to form a pouch with a lateral opening. The method further includes positioning and enclosing a stretchable binder at the vicinity of the lateral opening of the pouch, and stitching utilizing the sewing thread along a longitudinal axis in the middle of the pouch to enable division of the lateral opening into multiple lateral opening portions and enable insertion and withdrawal of legs of the user, thus forming the wearable leg warmer to retain body heat of the user and warm feet of the user.

Various embodiments of the present disclosure provide a wearable leg warmer and a method to form a wearable leg warmer for retaining body heat. The wearable leg warmer includes a soft clothing fabric defined within multiple lateral edges and multiple longitudinal edges. The soft clothing fabric for the wearable leg warmer provides maximum comfort level to a user during prolonged exposure to the wearable leg warmer. Each longitudinal edge of the multiple longitudinal edges folded is laterally and stitched utilizing a sewing thread to form a pouch with a lateral opening. The stretchable binder is positioned and enclosed at the vicinity of the lateral opening of the pouch to prevent the wearable leg warmer from slipping off the legs of the user. The sewing thread is utilized to stitch along a longitudinal axis in the middle of the pouch to enable division of the lateral opening into multiple lateral opening portions and enable insertion and withdrawal of legs of the user, thus retaining body heat of the user and warming feet of the user. Thus, the wearable leg warmer provides warmth and a soothing sensation throughout the body which, in turn, may induce sleep naturally.

BRIEF DESCRIPTION OF THE DRAWINGS

The illustrated embodiments of the subject matter will be best understood by reference to the drawings, wherein like parts are designated by like numerals throughout. The following description is intended only by way of example, and simply illustrates certain selected embodiments of devices, systems, and processes that are consistent with the subject matter as claimed herein.

DETAILED DESCRIPTION

Figure 1B:
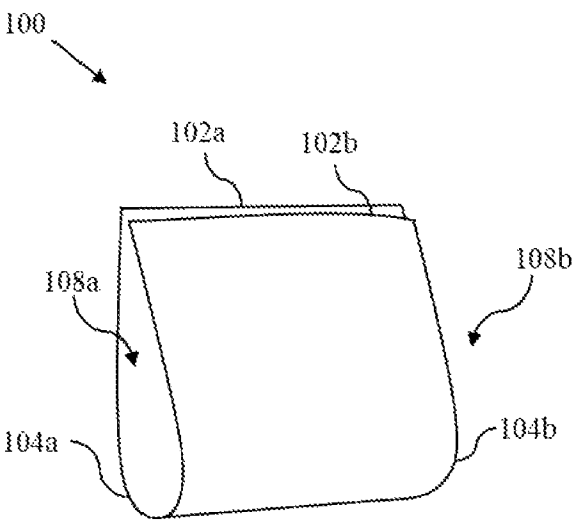
FIG. 1B is a diagram illustrating folding of the soft clothing fabric of FIG. 1A laterally in accordance with an embodiment of the present disclosure.

Example apparatus are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Consistency in body temperature in humans is essential for uninterrupted sleep. However, legs or more particularly feet get cold due to tendency of losing body heat through conduction, radiation, convection leading to lowering of the ideal body temperature. Typically, cold feet take a long time to warm up and make falling asleep more difficult. To solve the aforementioned problem, the present disclosure provides a pouch like apparatus (wearable leg warmer) in which a user may insert his legs such that the apparatus has an elasticized non- restrictive opening to help keep the apparatus in place above the ankles of the user and simultaneously allows effortless removal when required. The apparatus provides warmth and a soothing sensation throughout the body of the user which, in turn, may induce sleep naturally. The formation of the apparatus (i.e., a wearable leg warmer) for retaining body heat of the user and keeping the feet of the user warm is explained in detail in conjunction with FIGS. 1A, 1B, 2A-2C, 3A, and 3B.

Figure 1A:
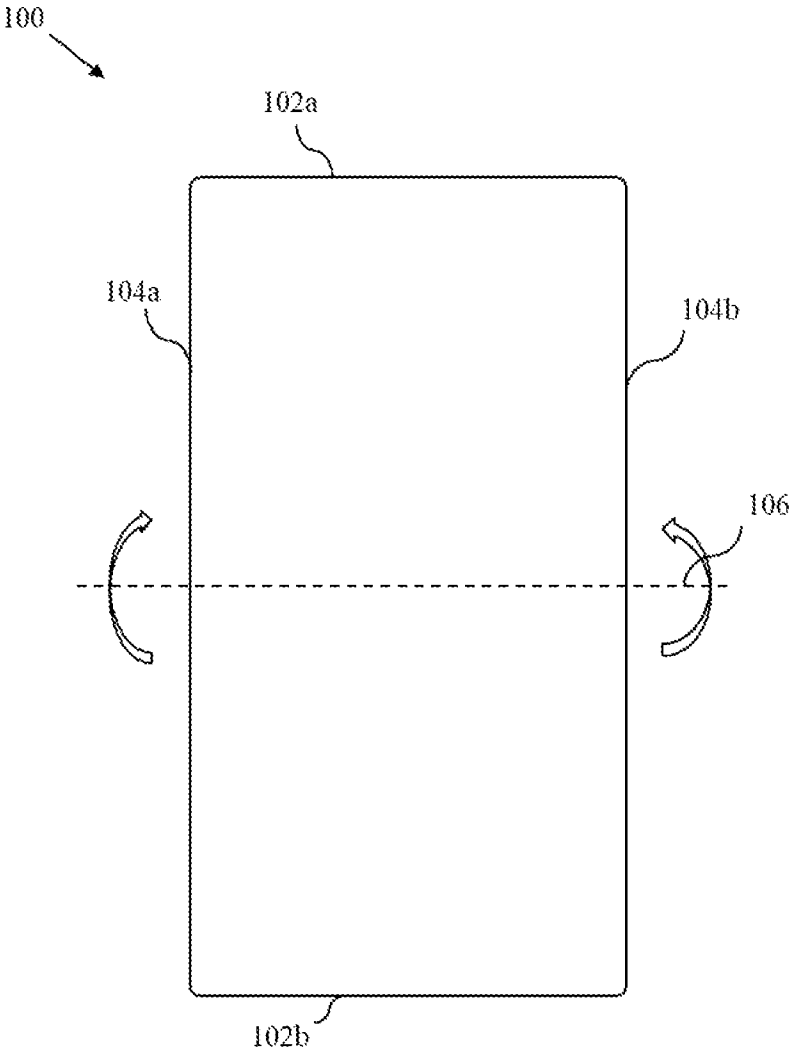
FIG. 1A is a diagram illustrating a soft clothing fabric in accordance with an embodiment of the present disclosure.

FIG. 1A is a diagram illustrating a soft clothing fabric 100 in accordance with an embodiment of the present disclosure. The soft clothing fabric 100 is utilized to form a wearable leg warmer (shown later in FIGS. 3A and 3B). The soft clothing fabric 100 is defined within a plurality of lateral edges and a plurality of longitudinal edges. In one embodiment, the plurality of lateral edges include two lateral edges, such as first and second lateral edges 102*a* and 102*b*, and the plurality of longitudinal edges include two longitudinal edges, such as first and second longitudinal edges 104*a* and 104*b*. Thus, in one embodiment, the soft clothing fabric 100 has a quadrilateral shape having four edges, as shown in FIG. 1A.

A separation between the plurality of lateral edges, i.e., the first and second lateral edges 102*a* and 102*b*, of the soft clothing fabric 100 is greater than a separation between the plurality of longitudinal edges, i.e., the first and second longitudinal edges 104*a* and 104*b*, of the soft clothing fabric 100. In one example, the soft clothing fabric 100 has a rectangular shape. It will be apparent to a person skilled in the art that although in the current embodiment, the soft clothing fabric 100 has two longitudinal edges and two lateral edges and has a rectangular shape, the scope of the present disclosure is not limited to it. In various other embodiments, the soft clothing fabric 100 has more than two longitudinal edges and more than two lateral edges and has any suitable shape, without deviating from the scope of the present disclosure.

The soft clothing fabric 100 for the wearable leg warmer provides maximum comfort level to a user during prolonged exposure to the wearable leg warmer. In one embodiment, the soft clothing fabric 100 for the wearable leg warmer corresponds to a sherpa material. The sherpa material is thick and extremely soft to touch. In one example, the sherpa material is a blend of at least one of: a microfiber material, a polyester material, and a recycled fabric material.

The soft clothing fabric 100 is selected such that dimensions of the soft clothing fabric 100 defined by the plurality of lateral and longitudinal edges are premeasured dimensions (or sizes). In one example, the premeasured dimensions are small, regular, large, extra-large, and the like. In one embodiment, the premeasured dimensions may correspond to half the length of the soft clothing fabric 100.

FIG. 1B is a diagram illustrating folding of the soft clothing fabric laterally in accordance with an embodiment of the present disclosure. Each longitudinal edge of the plurality of longitudinal edges is folded laterally to overlap with respect to a lateral axis 106, thus forming a plurality of folded longitudinal edges. In one embodiment, the first longitudinal edge 104*a* is folded laterally such that the fold is at the lateral axis 106 to form a first folded longitudinal edge 108*a* of the plurality of longitudinal edges, and the second longitudinal edge 104*b* is folded laterally such that the fold is at the lateral axis 106 to form a second folded longitudinal edge 108*b* of the plurality of longitudinal edges.

Each longitudinal edge of the plurality of longitudinal edges is folded laterally to form the plurality of folded longitudinal edges having a length based on a predefined size associated with the user. The predefined size is proportional to the premeasured dimension of the soft clothing fabric 100. The plurality of lateral edges of the soft clothing fabric 100 of the wearable leg warmer are rendered parallel to each other after folding the plurality of longitudinal edges. In this embodiment, the first lateral edge 102*a* is rendered parallel to the second lateral edge 102*b* after folding the first and second longitudinal edges 104*a* and 104*b* along the lateral axis 106, as shown in FIG. 1B.

Figure 2B:
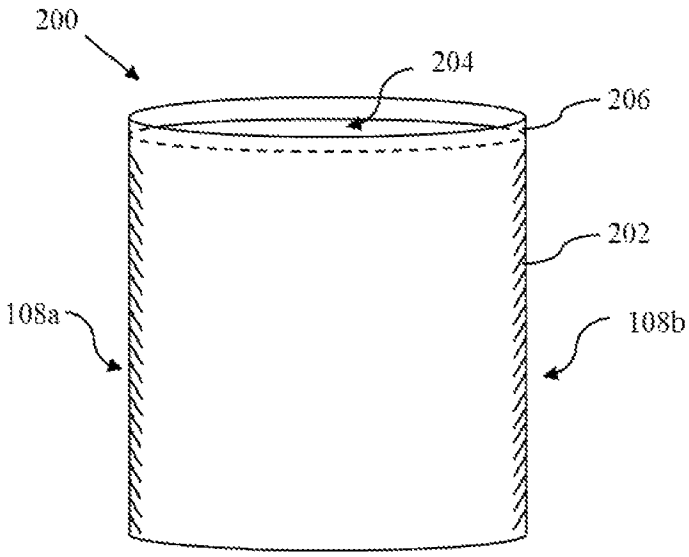
FIG. 2B is a diagram illustrating a casing formed at the vicinity of a lateral opening of the pouch of FIG. 2A in accordance with an embodiment of the present disclosure.
Figure 2C:
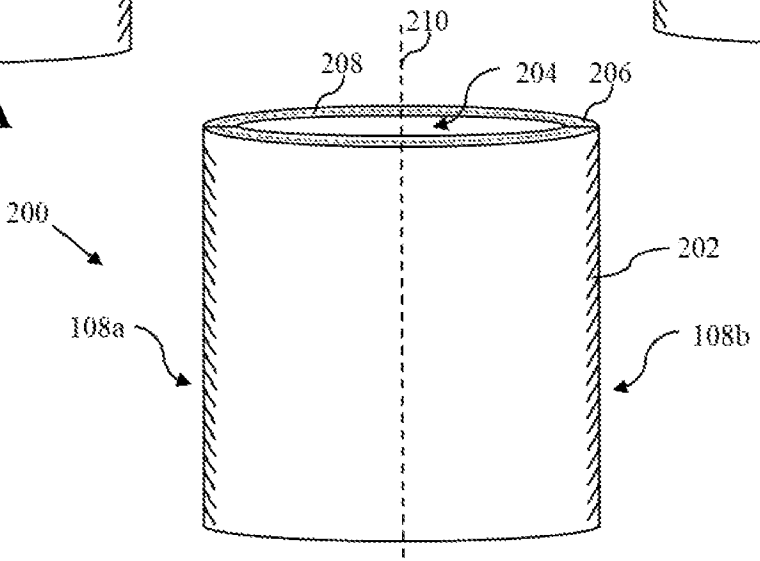
FIG. 2C is a diagram illustrating a stretchable binder positioned and enclosed in the casing of FIG. 2B in accordance with an embodiment of the present disclosure.
Figure 2A:
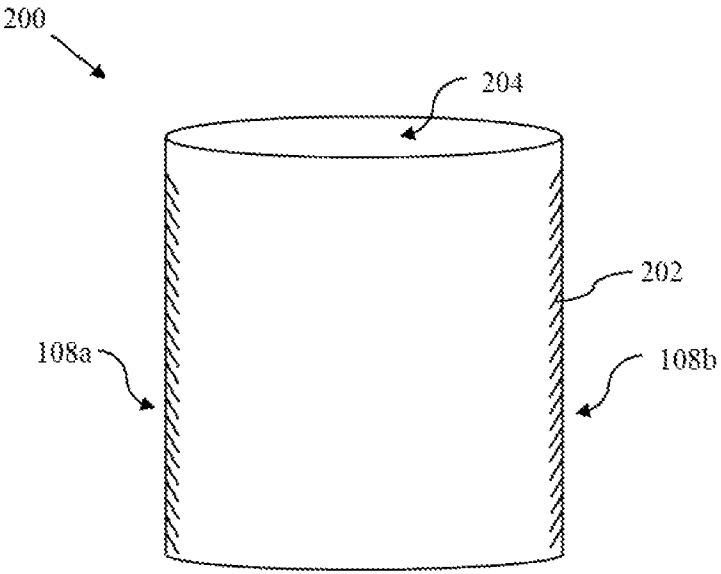
FIG. 2A is a diagram illustrating a pouch formed by stitching folded longitudinal edges of the soft clothing fabric of FIG. 1B in accordance with an embodiment of the present disclosure.

FIG. 2A is a diagram illustrating a pouch 200 formed by stitching the folded longitudinal edges of the soft clothing fabric 100 in accordance with an embodiment of the present disclosure. A sewing thread 202 is utilized to stitch along each of the plurality of folded longitudinal edges to form a pouch 200 with a lateral opening 204. In the current embodiment, the sewing thread 202 is utilized to stitch along each of the first and second folded longitudinal edges 108*a* and 108*b* to form the pouch 200 with the lateral opening 204, as shown in FIG. 2A. The sewing thread 202 utilized to stitch along each of the plurality of folded longitudinal edges corresponds to at least one of: a natural thread and a synthetic thread to form a seam pattern.

FIG. 2B is a diagram illustrating a casing 206 formed at the vicinity of the lateral opening 204 of the pouch 200 in accordance with an embodiment of the present disclosure. A stretchable binder 208 is positioned and enclosed at the vicinity of the lateral opening 204 of the pouch 200.

FIG. 2C is a diagram illustrating the stretchable binder 208 positioned and enclosed in the casing 206 of FIG. 2B in accordance with an embodiment of the present disclosure. In one embodiment, the pouch 200 employs a casing 206 at the vicinity of the lateral opening 204 to enclose the stretchable binder 208. The casing 206 to enclose the stretchable binder 208 is formed by utilizing the sewing thread 202. Thus, forming the pouch 200 with an elasticized or non-restrictive opening.

It will be apparent to a person skilled in the art that although in the current embodiment, the pouch 200 employs a casing 206 at the vicinity of the lateral opening 204 to enclose the stretchable binder 208, the scope of the present disclosure is not limited to it. In various other embodiments, the stretchable binder 208 may be positioned and enclosed at the vicinity of the lateral opening 204 by way of any suitable means, for example, the stretchable binder 208 may be sewn in the soft clothing fabric 100 at the lateral opening 204, without deviating from the scope of the present disclosure.

The stretchable binder 208 is positioned and enclosed at the vicinity of the lateral opening 204 to help the wearable leg warmer be in place above the ankles of the user and prevent the wearable leg warmer from slipping of the legs of the user during prolonged usage of the wearable leg warmer. Further, the stretchable binder 208 enables the user to withdraw the legs from the wearable leg warmer with minimal human effort. In one embodiment, the stretchable binder 208 corresponds to an elastic material. In one example, the elastic material may be an elastic band, an elastic ring, or the like.

Figure 3B:
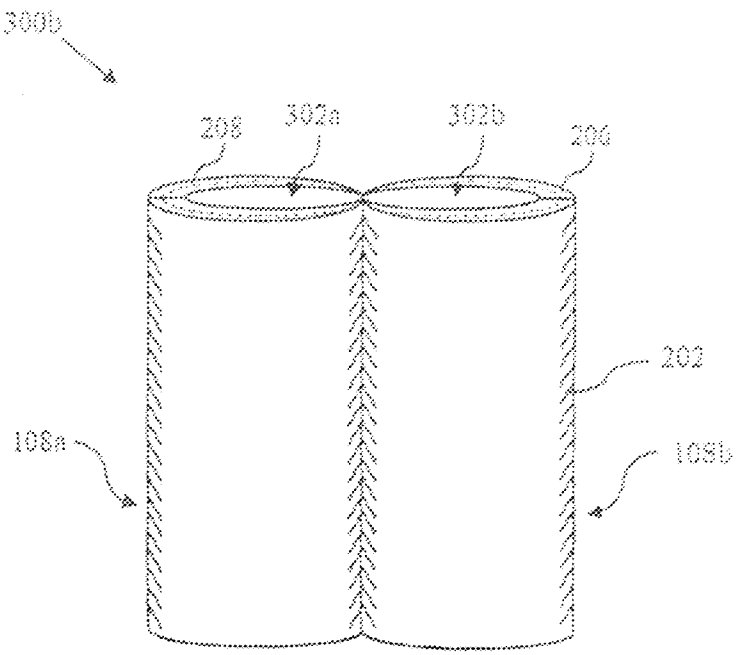
FIG. 3B is diagram illustrating a wearable leg warmer in accordance with another embodiment of the present disclosure.
Figure 3A:
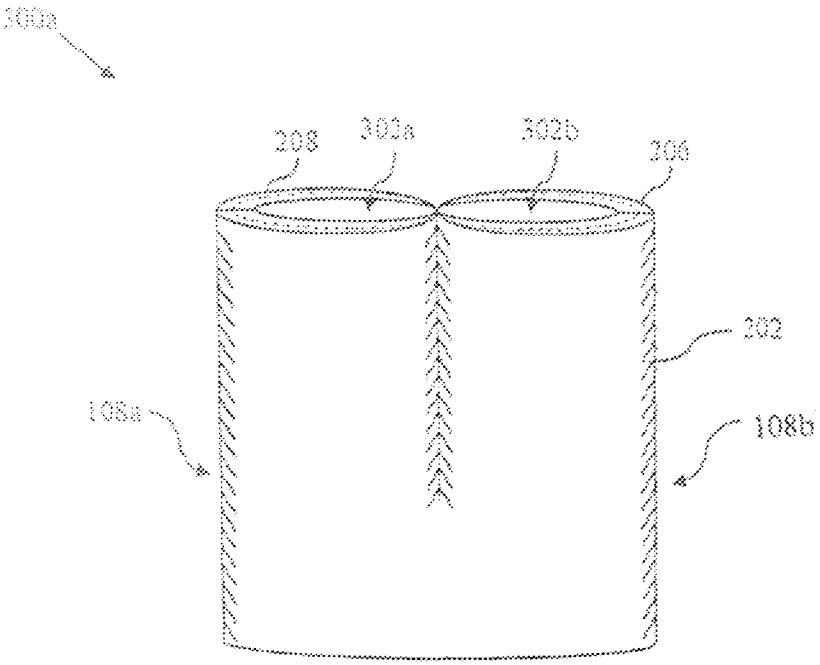
FIG. 3A is diagram illustrating a wearable leg warmer in accordance with an embodiment of the present disclosure.
Figure 4B:
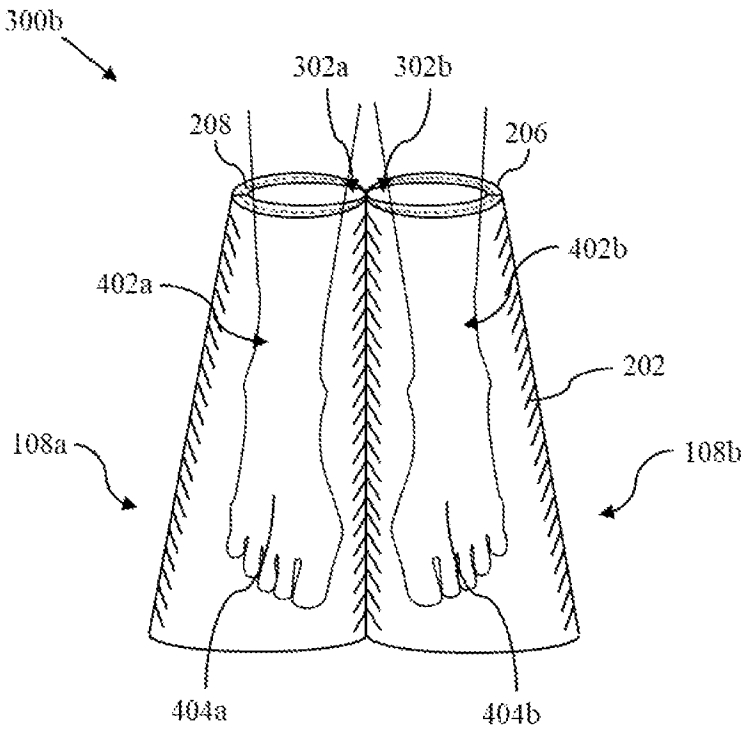
FIG. 4B is diagram illustrating a user wearing the wearable leg warmer of FIG. 3B in accordance with another embodiment of the present disclosure.
Figure 4A:
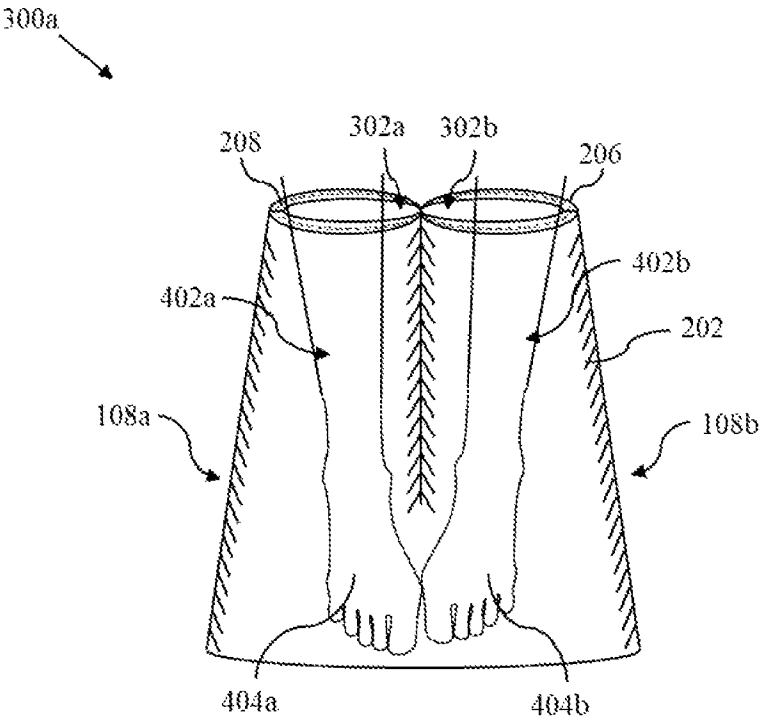
FIG. 4A is diagram illustrating a user wearing the wearable leg warmer of FIG. 3A in accordance with an embodiment of the present disclosure.

FIG. 3A is diagram illustrating a wearable leg warmer 300*a* in accordance with an embodiment of the present disclosure. FIG. 4A is diagram illustrating a user wearing the wearable leg warmer 300*a* in accordance with an embodiment of the present disclosure. The sewing thread 202 is utilized to stitch along a longitudinal axis 210 (as shown in FIG. 2C) in the middle of the pouch 200 to enable division of the lateral opening 204 into a plurality of lateral opening portions and enable insertion and withdrawal of legs 402*a* and 402*b* of the user. Thus, retaining body heat of the user and warming feet 404*a* and 404*b* of the user. In one embodiment, the plurality of lateral opening portions include first and second lateral opening portions 302*a* and 302*b* through which the user may insert or withdraw the leg 402*a* and the leg 402*b*, respectively.

The stitch along the longitudinal axis 210 in the middle of the pouch 200 extends from the lateral opening 204 till at least a predefined length as shown in FIG. 3A, thus forming the wearable leg warmer 300*a* that enables foot of each leg, i.e., the foot 404*a* and foot 404*b*, of the user inserted in corresponding lateral opening portion of the plurality of lateral opening portions to be in physical contact with each other as shown in FIG. 4A. In one example, the predefined length may be three fourth of a length of the pouch 200. In another example, the predefined length may be half the length of the pouch 200. Although the legs 402*a* and 402*b* are inserted through different lateral opening portions 302*a* and 302*b*, respectively, the feet 404*a* and 404*b* are able to be in physical contact at the bottom of the wearable leg warmer 300*a*. The sewing thread 202 utilized to stitch along the longitudinal axis 210 in the middle of the pouch 200 corresponds to at least one of: a natural thread and a synthetic thread to form a seam pattern.

FIG. 3B is diagram illustrating a wearable leg warmer 300*b* in accordance with another embodiment of the present disclosure. FIG. 4B is diagram illustrating a user wearing the wearable leg warmer 300*b* in accordance with another embodiment of the present disclosure. The sewing thread 202 is utilized to stitch along the longitudinal axis 210 (as shown in FIG. 2C) in the middle of the pouch 200 to enable division of the lateral opening 204 into the plurality of lateral opening portions and enable insertion and withdrawal of legs 402*a* and 402*b* of the user. Thus, retaining body heat of the user and warming feet 404*a* and 404*b* of the user. In one embodiment, the plurality of lateral opening portions include first and second lateral opening portions 302*a* and 302*b* through which the user may insert or withdraw the leg 402*a* and the leg 402*b*, respectively.

The stitch along the longitudinal axis 210 in the middle of the pouch 200 extends from the lateral opening 204 to an entire length of the pouch 200 as shown in FIG. 3B, thus forming the wearable leg warmer 300*b* that enables foot of each leg, i.e., the foot 404*a* and foot 404*b*, of the user inserted in corresponding lateral opening portion of the plurality of lateral opening portions to remain isolated from each other as shown in FIG. 4B.

It will be apparent to a person skilled in the art that although in the current embodiment, the sewing thread 202 is utilized to stitch along the longitudinal axis 210 to form a division of the lateral opening 204 and the pouch 200, the scope of the present embodiment is not limited to it. In various other embodiments, any suitable mechanism, such as a zipper or Velcro may be utilized to form a division of the lateral opening 204 and the pouch 200, without deviating from the scope of the present embodiment.

In one embodiment, when the zipper is utilized to form a division of the lateral opening 204 and the pouch 200, the zipper zips from the lateral opening 204 towards the end of the pouch 200. Thus, when zipped the feet 404*a* and 404*b* are isolated from each other and when unzipped the feet 404*a* and 404*b* are able to be in physical contact with each other.

The user may slip his/her legs 402*a* and 402*b* in the corresponding lateral opening portions 302*a* and 302*b*, respectively, of the wearable leg warmer 300*a* and 300*b*. Each foot may remain separated in the wearable leg warmer 300*b* and may remain in touch with the other foot in the wearable leg warmer 300*a*. The feet 404*a* and 404*b* are swaddled in the soft clothing fabric 100 creating warmth and a soothing feeling throughout the body. The wearable leg warmer 300*a* or 300*b* may be utilized by a user in any position, such as while lying down, while sitting, or the like, when the feet need to be warmed or when the user needs to relax or relieve stress. The user may effortlessly wiggle his/her legs 402*a* and 402*b* out of the wearable leg warmer 300*a* or 300*b* when required.

Figure 5:
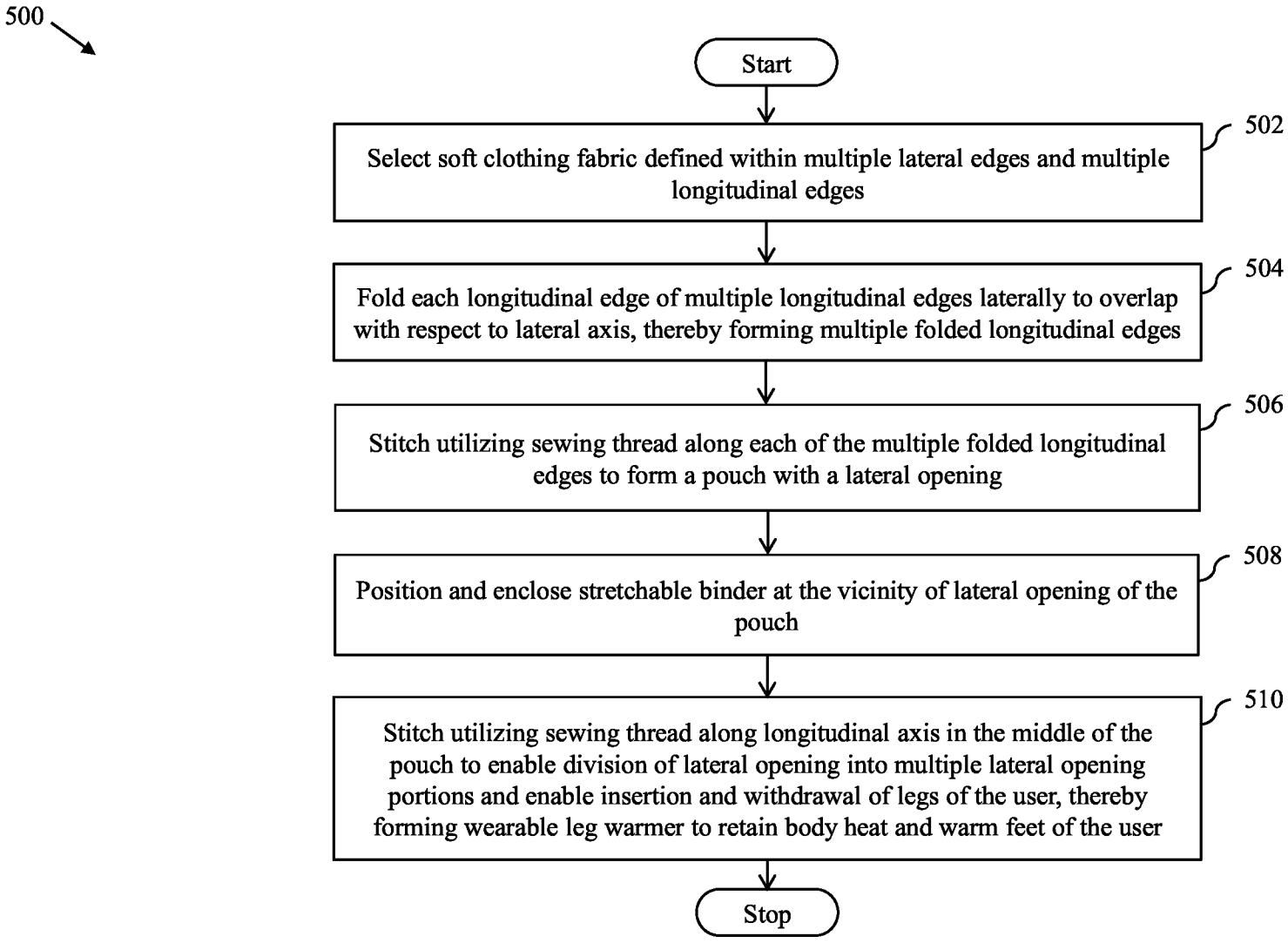
FIG. 5 is a flow chart illustrating a method for forming a wearable leg warmer to retain body heat in accordance with an embodiment of the present disclosure.

FIG. 5 is a flow chart illustrating a method for forming the wearable leg warmer 300*a* or 300*b* to retain body heat in accordance with an embodiment of the present disclosure.

At step 502, the soft clothing fabric 100 defined within the plurality of lateral edges and the plurality of longitudinal edges is selected. The soft clothing fabric 100 for the wearable leg warmer 300*a* or 300*b* provides maximum comfort level to a user during prolonged exposure to the wearable leg warmer 300*a* or 300*b*.

At step 504, each longitudinal edge of the plurality of longitudinal edges is folded laterally to overlap with respect to the lateral axis 106, thus forming the plurality of folded longitudinal edges.

At step 506, each of the plurality of folded longitudinal edges is stitched utilizing the sewing thread 202 to form the pouch 200 with the lateral opening 204.

At step 508, the stretchable binder 208 is positioned and enclosed at the vicinity of the lateral opening 204 of the pouch 200. In one embodiment, the pouch 200 employs the casing 206 at the vicinity of the lateral opening 204 to enclose the stretchable binder 208.

At step 510, the soft clothing fabric 100 is stitched utilizing the sewing thread 202 along the longitudinal axis 210 in the middle of the pouch 200 to enable division of the lateral opening 204 into a plurality of lateral opening portions and enable insertion and withdrawal of legs 402*a* and 402*b* of the user, thus forming the wearable leg warmer 300*a* or 300*b* to retain body heat of the user and warm the feet 404*a* and 404*b* of the user.

In one embodiment, the stitch along the longitudinal axis 210 in the middle of the pouch 200 extends from the lateral opening 204 till at least the predefined length, thus enabling foot of each leg of the user inserted in corresponding lateral opening portion of the plurality of lateral opening portions to be in physical contact with each other. In another embodiment, the stitch along the longitudinal axis 210 in the middle of the pouch 200 extends from the lateral opening 204 to an entire length of the pouch 200, thus enabling foot of each leg of the user inserted in corresponding lateral opening portion of the plurality of lateral opening portions to remain isolated from each other.

The wearable leg warmer 300*a* or 300*b* retain body heat of the user and warm feet 404*a* and 404*b* of the user. Thus, the wearable leg warmer 300*a* or 300*b* provides warmth and a soothing sensation throughout the body. The warmth and comforting feeling potentially helps to induce sleep naturally.

Although the disclosure is described herein with reference to specific embodiments, various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure. Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements.

Unless otherwise stated, conditional languages such as "can," "could," "will," "might," or "may" are understood within the context as used in general to convey that certain embodiments include, while other embodiments do not include, certain features and/or elements. Thus, such conditional languages are not generally intended to imply that features and/or elements are in any way required for one or more embodiments.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.).

What is claimed is:

1. A wearable leg warmer comprising: a sherpa material defined within a plurality of lateral edges and a plurality of longitudinal edges; a sewing thread; and a stretchable binder, wherein the sherpa material for the wearable leg warmer provides user comfort based on thermal insulation, breathability, and moisture management during prolonged exposure to the wearable leg warmer;

each longitudinal edge of the plurality of longitudinal edges are folded laterally to overlap with respect to a lateral axis, thereby forming a plurality of folded longitudinal edges; the sewing thread stitching along each of the plurality of folded longitudinal edges to form a pouch with a lateral opening, the stretchable binder positioned and enclosed at the lateral opening of the pouch, and the sewing thread stitching along a longitudinal axis in a middle of the pouch to enable division of the lateral opening into a plurality of lateral opening portions and to enable insertion and withdrawal of a user's legs thereby retaining the user's body heat and warming feet of the user.

2. The wearable leg warmer of claim 1, wherein the stitching along the longitudinal axis in the middle of the pouch extends from the lateral opening until at least a predefined length, and configured to allow insertion of the user's foot on each leg of the user into a corresponding lateral opening portion of the plurality of lateral opening portions to thereby allow physical contact with each other.

3. The wearable leg warmer of claim 1, wherein the stitching along the longitudinal axis in the middle of the pouch extends from the lateral opening to an entire length of the pouch creating separate foot retention portions allowing the insertion of each foot of the user into a corresponding lateral opening portion of the plurality of lateral opening portions.

4. The wearable leg warmer of claim 1, wherein the plurality of longitudinal edges include two longitudinal edges, and the plurality of lateral edges include two lateral edges.

5. The wearable leg warmer of claim 1, wherein a separation between the plurality of lateral edges of the sherpa material is greater than a separation between the plurality of longitudinal edges of the sherpa material.

6. The wearable leg warmer of claim 1, wherein each longitudinal edge of the plurality of longitudinal edges folded laterally to form the plurality of folded longitudinal edges are configured to be based on a predetermined size associated with the user.

7. The wearable leg warmer of claim 1, wherein the sewing thread stitching along each of the plurality of folded longitudinal edges and along the longitudinal axis in the middle of the pouch corresponds to at least one of: a natural fiber thread and a synthetic fiber thread to form a seam pattern.

8. The wearable leg warmer of claim 1, wherein the plurality of lateral edges of the sherpa material of the wearable leg warmer are rendered parallel to each other after folding the plurality of longitudinal edges.

9. The wearable leg warmer of claim 1, wherein the pouch employs a casing at the lateral opening to enclose the stretchable binder.

10. The wearable leg warmer of claim 1, wherein the stretchable binder positioned and enclosed at the lateral opening of the pouch is configured to prevent the wearable leg warmer from slipping off the legs of the user during prolonged usage of the wearable leg warmer.

11. The wearable leg warmer of claim 1, wherein the stretchable binder is positioned and enclosed about the lateral opening of the pouch thereby enabling the user to withdraw the legs from the wearable leg warmer with minimal human effort.

12. The wearable leg warmer of claim 1, wherein the stretchable binder corresponds to an elastic material.

13. A method for forming a wearable leg warmer to retain body heat, comprising:

selecting a sherpa material defined within a plurality of lateral edges and a plurality of longitudinal edges, wherein the sherpa material provides user comfort based on thermal insulation, breathability, and moisture management during prolonged exposure to the wearable leg warmer;

folding each longitudinal edge of the plurality of longitudinal edges laterally to overlap with respect to a lateral axis, thereby forming a plurality of folded longitudinal edges;

stitching with a sewing thread along each of the plurality of folded longitudinal edges to form a pouch with a lateral opening;

positioning and enclosing a stretchable binder at the lateral opening of the pouch; and stitching with the sewing thread along a longitudinal axis in a middle of the pouch to enable division of the lateral opening into a plurality of lateral opening portions for enabling the insertion and withdrawal of legs of the user wherein the wearable leg warmer is thereby configured to retain body heat and warm a user's feet.

14. The method of claim 13 wherein the stitching along the longitudinal axis in the middle of the pouch extends from the lateral opening to at least a predefined length, thereby configured to enable a foot of each leg of the user inserted into a corresponding lateral opening portion of the plurality of lateral opening portions to be in physical contact with each other.

15. The method of claim 13, wherein the stitch along the longitudinal axis in the middle of the pouch extends from the lateral opening to an entire length of the pouch, thereby enabling each foot of the user inserted into a corresponding lateral opening portion of the plurality of lateral opening portions to thereby remain isolated from each other.

16. The method of claim 13, wherein each longitudinal edge of the plurality of longitudinal edges are folded laterally to form the plurality of folded longitudinal edges and configured to be based on a predefined size associated with the user.

17. The method of claim 13, wherein the sewing thread to stitching each of the plurality of folded longitudinal edges and along the longitudinal axis in the middle of the pouch corresponds to at least one of: a natural fiber thread and a synthetic fiber thread to form a seam pattern.

18. The method of claim 13, wherein the plurality of lateral edges of the sherpa material of the wearable leg warmer is rendered parallel to each other after folding the plurality of longitudinal edges.

19. The method of claim 13, wherein the pouch employs a casing at the lateral opening to enclose the stretchable binder.

20. The method of claim 13, wherein the stretchable binder positioned and enclosed at the lateral opening of the pouch is configured to prevent the wearable leg warmer from slipping off the legs of the user during prolonged usage of the wearable leg warmer.

21. The method of claim 14, wherein the stretchable binder positioned and enclosed at the lateral opening of the pouch enables the user to withdraw legs from the wearable leg warmer with minimal human effort.

22. The method of claim 14, wherein the stretchable binder corresponds to an elastic material.

* * * * *